United States Patent [19]

Balinski

[11] 3,940,899

[45] Mar. 2, 1976

[54] STUD HAVING STRUCK-OUT FLANGES AND FIRE-RATED WALL STRUCTURE FORMED THEREWITH

[75] Inventor: Henry A. Balinski, Hoffman Estates, Ill.

[73] Assignee: United States Gypsum Company, Chicago, Ill.

[22] Filed: May 27, 1975

[21] Appl. No.: 580,994

[52] U.S. Cl. ..... 52/481; 52/495; 52/735

[51] Int. Cl.[2] ..... E04B 2/30; E04B 2/78

[58] Field of Search ..... 52/354–356, 52/481, 484, 495–497, 729, 735, 738, 492, 715

[56] References Cited

UNITED STATES PATENTS

| | | | |
|---|---|---|---|
| 999,752 | 8/1911 | Connell | 52/241 X |
| 3,271,920 | 9/1966 | Downing, Jr. | 52/481 X |
| 3,702,044 | 11/1972 | Balinski | 52/481 X |
| 3,732,657 | 5/1973 | Nelsson | 52/481 X |
| 3,740,912 | 6/1973 | Sauer et al. | 52/479 |
| 3,839,839 | 10/1974 | Tillisch et al. | 52/481 X |
| 3,841,048 | 10/1974 | Jahn | 52/484 |

*Primary Examiner*—Alfred C. Perham
*Attorney, Agent, or Firm*—Samuel Kurlandsky; Stanton T. Hadley; Donnie Rudd

[57] ABSTRACT

A metal stud for constructing a fire-rated wall and the wall structure formed of a plurality of studs mounted in runners and having at least two spaced-apart layers of wallboard panels with adjacent panels in abutting relationship, the stud being formed of an integral piece of sheet metal and comprising a single layer web having a first plurality of oppositely directed flange means at one edge thereof, a web substantially perpendicular to the flange means, and a panel at the other edge of the web for supporting wallboard panels. Medial portions of the web are struck-out at longitudinally spaced-apart intervals to form a second pair of oppositely directed flange means substantially parallel to and spaced-apart from the first pair of oppositely directed flange means, the first and second flange cooperating with a portion of the web therebetween to define a plurality of oppositely directed channels engaging edges of a first layer of wallboard panels, and a second layer of wallboard panels affixed to the panels of the stud at the other end of the web, the over-all wall structure having excellent fire-rating properties.

19 Claims, 5 Drawing Figures

STUD HAVING STRUCK-OUT FLANGES AND FIRE-RATED WALL STRUCTURE FORMED THEREWITH

BACKGROUND OF THE INVENTION

1. Field of Invention

The present invention relates to wall constructions, and more particularly refers to studs which may be utilized to form fire-retardant or fire-rated wall structures particularly for use in enclosing open shafts in multi-story buildings such as offices and high-rise apartments, and to the wall structures formed therewith.

2. Description of the Prior Art

Walls enclosing shafts such as air return shafts, elevator shafts, and stairwell shafts commonly separate the shafts from other rooms such as corridors, toilets, and utility rooms. With increasing governmental concern for promoting safety for occupants of public buildings, manufacturers of building products have sought to provide shaft walls meeting at least minimal safety requirements, while at the same time, providing builders with materials that are both easy to install and low in cost.

Two of the most important of these safety requirements concern wind loading and fire ratings. Destructive wind loading is of particular concern where the shaft is an air return shaft or an elevator shaft, where pressures or vacuums are developed which load the shaft wall up to 15 pounds per square foot in excess of atmospheric pressure.

Cavity walls, and particularly those utilized for enclosing elevator shafts, stairwells, and air return shafts, are continually being subjected to increasingly stringent fire code requirements. The trend is to require such walls to meet or surpass certain fire ratings measured pursuant to ASTM E-119 Fire Rating Test. Elevator shaft walls require, for example at least a 2-hour rating. Where the wall system is "unbalanced", increasingly, code enforcement organizations are requiring that the rating be achieved from both sides of the wall. To pass such tests, each transfer through the metal studs used to construct such walls must be substantially reduced. At the same time, however, the stud must still retain a sufficient degree of structural strength, and in addition, must meet economic requirements. Moreover, the engagement of the stud with the wall panels which they support must be of such nature that construction is achieved with a minimum of required labor and materials. The structure must, nevertheless, withstand the requirements of accurate and complete engagement of the panels and studs, to ensure that the fire rating will be achieved.

The above fire problems concerning shafts can also be said to apply to long corridors in buildings, which in effect are horizontal, rather than vertical, shafts. Thus, without adequate fire ratings, a corridor wall easily transmits the fire throughout the floor as the fire proceeds along the corridor.

To solve these and other problems, early building shaft walls were commonly built up and lined with various types of block masonry, including both concrete and gypsum block. While block masonry has proved suitable for many applications, it has been found to be undesirable in those situations where the shaft rises to great heights. Further, block masonry structures cannot withstand high wind loading. Because of their great weight, concrete block masonry materials require supporting structures of great weight and strength. An additional problem is that these heavy materials give rise to problems in their installation. Those skilled in installing the above-described shaft lining materials are forced to handle them at dangerously high levels.

Walls of the type described and related structures have been disclosed in the prior art, and particularly in U.S. Pat. Nos. 3,740,912, 3,702,044, 3,609,933, 3,016,116, 3,094,197, 999,752, 3,495,417, 3,271,920, 3,839,839, and many others. However, even though many of the structures disclosed in these patents have proven to be highly satisfactory, the search has continued to provide wall structures of the type described of greater strength, and greater fire-retardant properties.

SUMMARY OF THE INVENTION

It is accordingly, an object of the invention to provide a stud for the construction of a cavity shaft wall for multi-story buildings, which walls meet safety standards of wind loading.

It is a further object to provide a stud for the production of a cavity shaft wall, which wall can meet required fire-rating tests.

It is an additional object to provide a stud for the production of a cavity shaft wall which is relatively inexpensive, lightweight, and relatively safe and easy to install.

It is a further object to provide a building structure utilizing studs of the type described wherein both layers of wallboard panels can be inserted from the outside or corridor side, thereby obviating the need for workmen to erect scaffolding and to work within an elevator shaft around which the shaft wall is being installed.

Other objects and advantages will become apparent upon reference to the drawings and detailed description.

According to the invention, a fire-rated cavity shaft wall structure is provided utilizing a plurality of metal studs according to the invention and a plurality of gypsum wallboard panels disposed to form two spaced-apart rows with each of the panels having two opposed vertical edges, a stud being interposed between adjacent panels and mounting the panels. Each of the studs has a web portion formed of a single layer of metal, a first pair of oppositely directed flanges provided at one edge of the web, and a supporting panel provided at the other edge of the web spaced-apart from the first set of flanges and substantially parallel thereto. Additionally, at spaced-apart intervals, a plurality of struck-out portions are provided in the web defining a second pair of oppositely spaced-apart flanges combining with the first pair of spaced-apart flanges and the web portion therebetween to define a pair of oppositely directed channels engaging adjacent edges of a pair of wallboard panels of the first layer, and having a second layer of wallboard panels affixed to the supporting panel of each stud.

DESCRIPTION OF THE PREFERRED EMBODIMENTS

Figure 1:
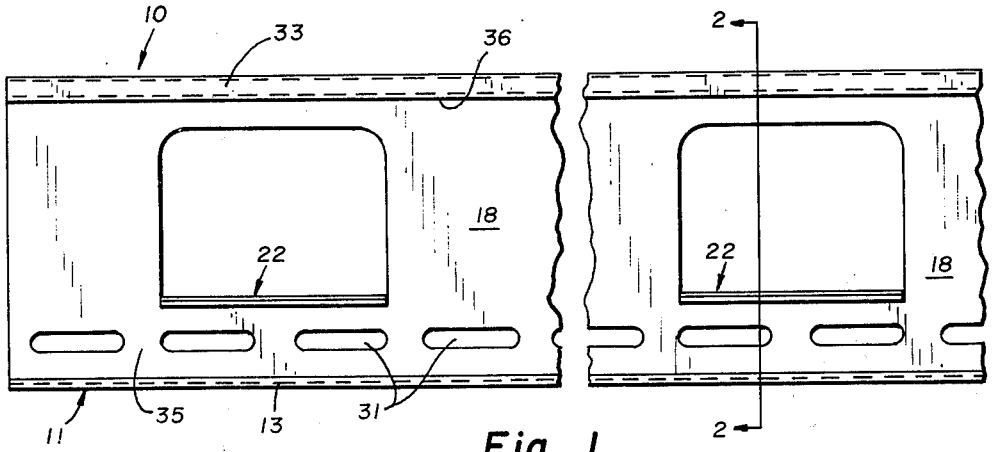
FIG. 1 is a side elevational view of a stud according to the invention.
Figure 2:
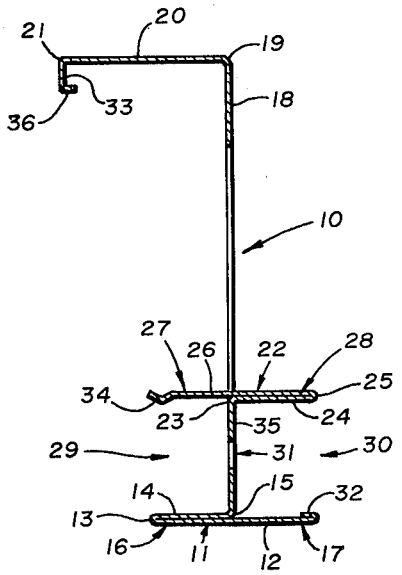
FIG. 2 is a cross-sectional view taken at the line 2—2 of FIG. 1, looking in the direction of the arrows.
Figure 3:
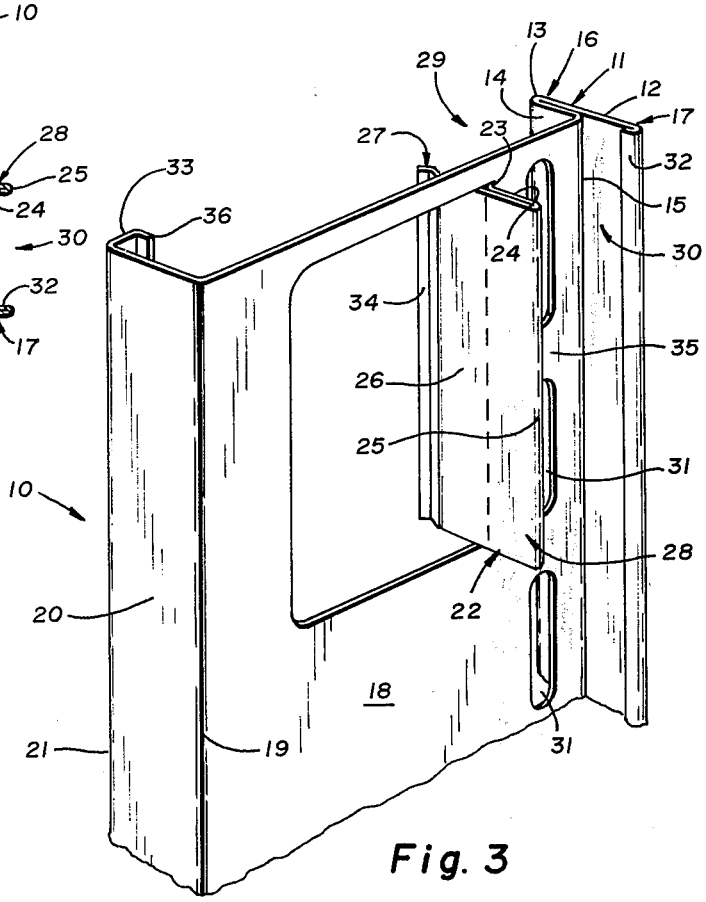
FIG. 3 is a perspective view of the stud shown in FIGS. 1 and 2.

Referring to FIGS. 1–3, a stud 10 is shown formed of a unitary integral sheet of metal such as steel or aluminum. The stud comprises a first flange-forming panel 11 comprising an outer panel member 12 terminating at a first fold 13, and an inner panel member 14 connected at the first fold 13 and folded over onto the outer panel member 12 and extending to a second fold 15 thereby defining a pair of oppositely directed flanges 16 and 17. A web 18 is connected at the second fold and extends away from the panel 11, terminating at the opposite edge of the stud at a third fold 19. A wallboard-supporting panel 20 is connected at the third fold 19 and extends substantially parallel to the first flange-forming 11 to a fourth fold 21.

A plurality of second flange-forming panels 22 are struck entirely from the web 18 and connected thereto at fifth folds 23. The panels 22 are discrete and spaced-apart longitudinally, and they each comprise an inner panel member 24 connected at the fifth fold and extending substantially perpendicularly to the web 18 to a sixth fold 25. An outer panel member 26 is connected at the sixth fold 25 and extends beyond the web 18 for a distance substantially equal to the width of the inner panel member 14. The second flange-forming panel 22 thereby provides a pair of oppositely directed flanges 27 and 28. The flange 27 is provided with a fluted or grooved edge 34 to facilitate insertion of a panel edge into the channel 29. The first and second flange-forming panels 11 and 22 define web member portions 35 of the web 18 therebetween and cooperate therewith to define a pair of oppositely directed channels 29 and 30.

In order to improve the fire-rating properties of a wall formed with the studs of the invention, a plurality of apertures 31 may be placed along the margin of the web 18 and extending through the web member portions 35. Since the web member portions 35 are positioned intermediate the edges of adjacent panels, the presence of the apertures improves the fire-rating properties since they break up the flow of heat within the stud. Additionally, they provide spaces into which heat from the wallboard panel edges may be dissipated.

In order to improve the structural rigidity of the stud, a lip 32 may be placed on the edge of the outer panel member 12, and a flange 33 may be placed on the wallboard-supporting panel 20. An additional flange 36 may also be provided, thereby forming a channel at the edge of the wallboard-supporting panel 20.

Figure 4:
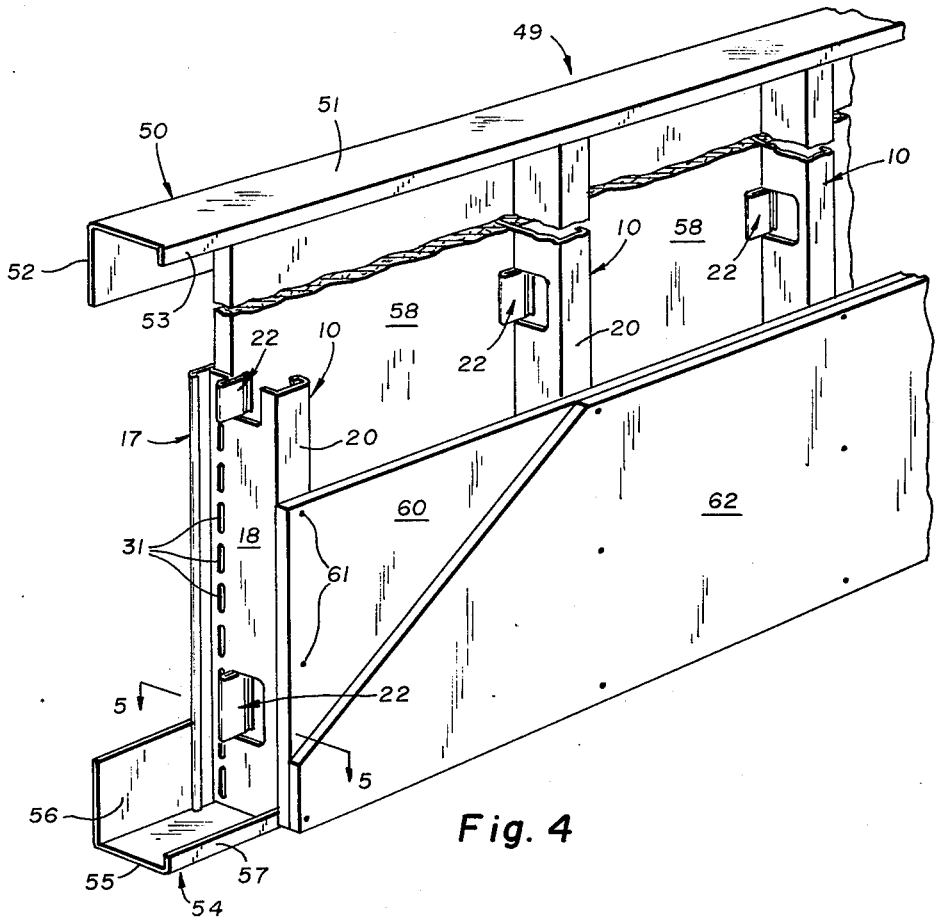
FIG. 4 is a perspective view of a portion of a cavity shaft wall embodying studs according to FIGS. 1–3.
Figure 5:
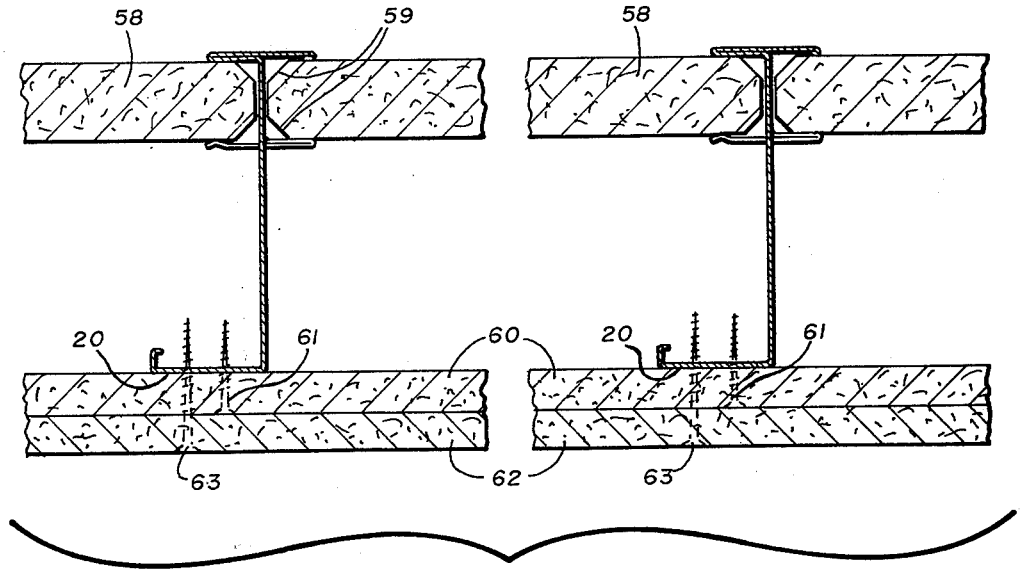
FIG. 5 is a cross-sectional view taken at the line 5—5 of FIG. 4, looking in the direction of the arrows.

Referring to FIGS. 4 and 5, a fire-rated wallboard structure is shown utilizing studs 10 as shown in FIGS. 1–3. The structure is in the form of a cavity shaft wall structure 49, suitable for assembly from the outer or corridor side with respect to the cavity around which the wall is assembled. The structure comprises an upper J-runner 50 having a web 51, a major or large flange 52 on the shaft side, and a minor or smaller flange 53 on the outer wall or corridor side. The runner 50 may be affixed to a ceiling structure. On the floor is mounted a lower J-runner 54 having a web 55, a major flange 56 on the shaft side, and a minor flange 57 on the outer or corridor side. A plurality of studs 10 are mounted inside the runners 50 and 54. As shown in the drawings, adjacent panels of a layer or row of gypsum wallboard or liner panels 58 are retained within the channels 29 and 30 of each stud and restrained in three directions by the web 18 and web portions 35 cooperating with the flanges 16, 17, 27 and 28. The liner panels 58 may be provided with beveled corners 59 to facilitate insertion into the channels of the stud.

A second layer of gypsum wallboard panels 60 is affixed to the wallboard-supporting panels 20 of the studs by means of screws 61. A third layer of wallboard panels 62 is affixed to the second layer of panel 60 by means of screws 63. Alternatively, the third layer of wallboard panels 62 may be affixed to the first layer of panels 58 on the shaft wall side to provide a wall structure which is finished on both sides and suitable for use in applications such as stairwells.

In erecting the wall, because of the structure of the J-runners and studs, the entire wall may be assembled from the outside or corridor side of the shaft without the need for placing workmen on scaffolding within the shaft to assemble any portion of the wall from the shaft side. In assembling the wall, the runners 50 and 54 are first affixed to the ceiling and floor structures. A stud 10 is then inserted between the flanges of the runners and maintained in place by the flanges. The flanges may be screwed to the studs if desired. A wallboard panel 58 is then set into place with its bottom edge within the lower runner, and the upper edge is swung into place into the upper runner. The minor flange 53 is sufficiently narrow so that the upper edge of the wallboard panel 58 clears the flange and comes to rest against the major flange 52. It can then be moved laterally to become engaged within the channels 29 or 30. A second stud is then mounted between the runners and moved laterally until the opposite vertical edge of the panel 58 is engaged within one of the channels 29 or 30. Then another panel is inserted followed by another stud. This process continues until the entire inner wall is erected. The first outer wallboard panels 60 are then placed against the wallboard-supporting panel 20 of the studs and affixed in place by means of screws 61. The second layer of outer wallboard panels 62 is then placed against the first layer of panels 60 and affixed thereto and to the stud by means of screws 63.

The studs of the present invention are relatively inexpensive and simple to produce. They are strong and may be used to form a fire-rated wall having excellent fire resistant properties.

It is to be understood that the invention is not to be limited to the exact details of operation or structure shown and described in the specification and drawings, since obvious modifications and equivalents will be readily apparent to one skilled in the art.

What is claimed is:

1. A stud adapted for use in constructing a wall comprised of a pair of spaced-apart coplanar layers of gypsum wallboard panels in abutting relationship having a plurality of said studs interposed between said layers of wallboard panels and affixed thereto, said stud being formed of a unitary integral sheet metal structure and comprising:

A. A first wallboard panel layer-engaging structure comprising:

1. a first flange-forming panel comprising a. an outer panel member extending to a first fold, and b. an inner panel member connected at said first fold and folded over a surface of said outer panel member and extending to a second fold intermediate the edges of said outer panel member, thereby forming a pair of flanges one on each side of said second fold, 2. a web connected at said second fold and extending away from said first flange-forming panel, disposed substantially perpendicular thereto and extending to a third fold, and 3. a plurality of discrete longitudinally spaced-apart second flange-forming panels each formed of a single tab struck from a medial portion of said web and positioned substantially parallel with respect to said first flange-forming panel, each of said discrete panels comprising;

a. an inner panel member connected to said web at a fourth fold and disposed substantially perpendicular to said web and extending to a fifth fold, and b. an outer panel member connected at said fifth fold and folded over said inner panel member and extending beyond said web and terminating at a free edge, thereby forming a pair of flanges one on each side of said web, said first and said plurality of second flange-forming panels and said web cooperating to form a plurality of H-shaped structures in cross-section defining oppositely directed channels for receiving and restraining adjacent wallboard panels in three directions; and B. means for supporting a second layer of gypsum wallboard panels spaced apart from said first layer of panels comprising a wallboard-supporting panel connected at said third fold extending in a direction substantially parallel to and spaced-apart from said first flange-forming panel and adapted to permit said second layer of panels to extend across and be affixed to the outer surface of said supporting panel.

2. A stud according to claim 1, wherein said first fold and said fifth fold are on opposite sides of said web.

3. A stud according to claim 1, wherein said first fold and said fifth fold are on the same side of said web.

4. A stud according to claim 1, wherein a flange is provided on said wallboard-supporting panel to increase structural rigidity.

5. A stud according to claim 1, having apertures provided in said supporting web to permit passage of conduits, wires and pipes.

6. A stud according to claim 1, wherein the edges of said outer panel members of said second flange-forming panels are fluted to facilitate engagement of the edges of wallboard panels.

7. A stud according to claim 1, wherein said web is provided with a plurality of apertures.

8. A stud according to claim 7, wherein said apertures are elongate and arranged in a row.

9. A fire-retardant wall comprising in combination:

I. upper and lower runners

II. a plurality of studs mounted in said runners, each of said studs comprising:

A. a first wallboard panel layer-engaging structure comprising:

1. a first flange-forming panel comprising a. an outer panel member extending to a first fold, and b. an inner panel member connected at said first fold and folded over a surface of said outer panel member and extending to a second fold intermediate the edges of said outer panel member, thereby forming a pair of flanges one on each side of said second fold, 2. a web connected at said second fold and extending away from said first flange-forming panel, disposed substantially perpendicular thereto and extending to a third fold, and 3. a plurality of discrete longitudinally spaced-apart second flange-forming panels each formed of a single tab struck from a medial portion of said web and positioned substantially parallel with respect to said first flange-forming panel, each of said discrete panels comprising;

a. an inner panel member connected to said web at a fourth fold and disposed substantially perpendicular to said web and extending to a fifth fold, and b. an outer panel member connected at said fifth fold and folded over said inner panel member and extending beyond said web and terminating at a free edge, thereby forming a pair of flanges one on each side of said web, said first and said plurality of second flange-forming panels and said web cooperating to form a plurality of H-shaped structures in cross-section defining oppositely directed channels for receiving and restraining adjacent wallboard panels in three directions; and B. means for supporting a second layer of gypsum wallboard panels spaced apart from said first layer of panels comprising a wallboard-supporting panel connected at said third fold extending in a direction substantially parallel to and spaced-apart from said first flange-forming panel and adapted to permit said second layer of panels to extend across and be affixed to the outer surface of said supporting panel, and III. a first row of gypsum wallboard panels, the edges of adjacent panels being engaged and retained within the oppositely directed channels of said studs, and IV. a second row of gypsum wallboard panels engaged by and affixed to said wallboard supporting panels in substantially parallel spaced-apart relationship with respect to said first row.

10. A wall according to claim 9, wherein a third layer of gypsum wallboard panels is affixed to said second layer of wallboard panels.

11. A wall according to claim 9, wherein a third layer of gypsum wallboard panels is affixed to said first layer of wallboard panels.

12. A wall according to claim 9, wherein the first fold and the fifth folds of each stud are on opposite sides of said web.

13. A wall according to claim 9, wherein the first fold and fifth folds of each stud are on the same side of said web.

14. A wall according to claim 9, wherein a flange is provided on the wallboard-supporting panel of each stud to increase structural rigidity.

15. A wall according to claim 9, wherein apertures are provided in the supporting web of each stud to permit passage of conduits, wire and pipes.

16. A wall according to claim 9, wherein the corners of the vertical edges of each panel of said first layer are beveled to facilitate their insertion into said oppositely directed channels.

17. A wall according to claim 9, wherein the edges of the outer panel members of said second flange-forming panels are fluted to facilitate engagement of the edges of said wallboard panels.

18. A wall according to claim 9, wherein the web of each stud is provided with a plurality of apertures.

19. A wall according to claim 18, wherein said apertures are elongate and arranged in a row.

* * * * *